US006497381B2

(12) United States Patent
Rose

(10) Patent No.: US 6,497,381 B2
(45) Date of Patent: Dec. 24, 2002

(54) CHRISTMAS LIGHT STORAGE DEVICE

(76) Inventor: Michael L. Rose, 4720 N. Maple Grove Rd., Boise, ID (US) 83704

( * ) Notice: Subject to any disclaimer, the term of this patent is extended or adjusted under 35 U.S.C. 154(b) by 0 days.

(21) Appl. No.: 10/116,575

(22) Filed: Apr. 2, 2002

(65) Prior Publication Data

US 2002/0153446 A1 Oct. 24, 2002

Related U.S. Application Data

(63) Continuation-in-part of application No. 09/840,697, filed on Apr. 23, 2001, now Pat. No. 6,431,489.

(51) Int. Cl.[7] ..... B65H 75/22; B65H 75/28; B65H 75/40

(52) U.S. Cl. ..... 242/402; 242/405.2; 242/407.1; 242/588.2; 242/608.2; 242/608.5; 242/609.1

(58) Field of Search ..... 242/405.1, 405.2, 242/407, 905, 404.3, 402, 588.2, 609.1, 608, 608.2, 608.5, 405.3, 407.1; 206/419, 420

(56) References Cited

U.S. PATENT DOCUMENTS

| | | | | | |
|---|---|---|---|---|---|
| 1,024,089 | A | | 4/1912 | Magee | |
| 1,330,093 | A | * | 2/1920 | Robertson | 242/405.2 |
| 1,552,082 | A | * | 9/1925 | Riley | 242/905 |
| 3,011,734 | A | * | 12/1961 | Wilkinson | 242/905 |
| 3,201,059 | A | | 8/1965 | Wurkel | |
| 3,460,779 | A | * | 8/1969 | Peasley | 242/405.1 |
| 3,584,803 | A | * | 6/1971 | Williams | 242/405.2 |
| 3,921,927 | A | | 11/1975 | Esashi et al. | |
| 3,940,085 | A | * | 2/1976 | Campbell | 242/608.2 |
| 4,226,380 | A | * | 10/1980 | Gay | 242/588.2 |
| 4,917,323 | A | | 4/1990 | Wing | |
| 5,381,984 | A | * | 1/1995 | Hindsgual | 242/905 |
| 5,404,670 | A | * | 4/1995 | Noll | 242/405.1 |
| 5,556,055 | A | * | 9/1996 | Lindstrand | 242/608.2 |
| 5,575,437 | A | * | 11/1996 | Campbell | 242/609.1 |
| 5,641,075 | A | | 6/1997 | Mechlin | 211/26 |
| 5,676,250 | A | | 10/1997 | Walters | 206/419 |
| 5,695,148 | A | | 12/1997 | Christensen | 242/405.3 |
| 5,762,311 | A | | 6/1998 | Triglia | 248/523 |
| 5,868,334 | A | * | 2/1999 | Cedillo | 242/405.3 |
| 5,924,570 | A | * | 7/1999 | Sickles | 206/419 |
| 5,957,401 | A | | 9/1999 | O'Donnell | 242/404.3 |
| 5,975,455 | A | * | 11/1999 | Alegre | 242/407 |

OTHER PUBLICATIONS

International Search Report mailed Jul. 11, 2002 for PCT/US02/12360.

* cited by examiner

*Primary Examiner*—John M. Jillions
(74) *Attorney, Agent, or Firm*—Holland & Hart LLP

(57) ABSTRACT

A storage device for storing strings Christmas, holiday or other strings of lights when the strings of lights are not in use. The device has an end having slots therethrough through which one or more of the ends of the string of lights are placed. A cap is then utilized to hold the light string end in position while the string itself is wound around the exterior surface of the storage device.

18 Claims, 12 Drawing Sheets

CHRISTMAS LIGHT STORAGE DEVICE

PRIORITY

This application is a continuation-in-part and is with, claims priority from, and incorporates by reference inventor's prior application, filed Apr. 23, 2001, Ser. No. 09/840,697, now U.S. Pat. No. 6,431,489 titled "CHRISTMAS LIGHT STORAGE DEVICE."

BACKGROUND OF THE INVENTION

The present invention generally relates to storage devices, and more particularly to devices utilized to store strings of Christmas and other holiday lights.

Users of holiday lights, such as Christmas lights, often find a great annoyance in the storage of such lights. Stringed fights are typically packaged in prepackaged plastic wrappings placed in cardboard boxes, such packaging not easily allowing the user to compactly and securely store such lights after they have been used. Typically, a user is left with the prospect of winding up, balling up, wadding up, or boxing up their lights and storing them until the next holiday season arrives. Then, when the user unpacks, unwinds, and unknots these balls of rogue strings, such an experience is found to be extremely frustrating. Lost equipment, such as fuses and hangers is also an issue. The inability to easily check for broken/burnt out bulbs and replace them is a constant problem.

Numerous attempts have been made to accomplish the task of light string storage. A first example is U.S. Pat. No. 4,917,323 to Wing for a Christmas light storage device. The Wing device consists of one or more disks, each with a plurality of radially oriented slots around the outside circumference of the disks for allowing the wires of light sockets to be inserted through these slots.

The second device is shown in Mechlin, U.S. Pat. No. 5,641,075, and shows a storage rack and method for storing string lighting. The Mechlin rack has a tubular body having a number of slots opening at one end wherein the light bulbs are stored within the slots themselves. Another device is shown in Walters, U.S. Pat. No. 5,676,250. The Walters device shows a light string mounting storage system comprising a tube having end caps. The tube has a solitary notch in each end for allowing a user to store the electrical connection of the light string inside the tube.

Another light storage device is shown in Christensen, U.S. Pat. No. 5,695,148. The Christensen device is reel on which Christmas lights can be wound.

And finally, U.S. Pat. No. 5,957,401 to O'Donnell shows a device for storing a string of lights. The O'Donnell device is in the spool form.

These devices tried to make storage more convenient and easy. However, none of these devices allows for ease of use, both installing and taking down light strings, expediency, relatively tangle-free storage, and a convenient means of verifying the functionality of the lights on the light string. A need exists for an inexpensive and easy to use device and method for the storage of strings of lights and related accessories. The present invention is directed towards this need.

SUMMARY OF THE INVENTION

The present invention is a storage device for storing at least one string of Christmas or other holiday lights. Such a string of Christmas lights will have a plurality of light bulbs which are typically connected together by two or three wires. This string of lights will have a string first end which terminates at a first electrical plug, and a string second end which terminates at a second electrical plug, these electrical plugs being coupled to the wires.

One embodiment of the invented storage device utilizes a hollow tube having a side wall. This side wall has a length and an exterior surface. The tube has a first end and second end, this hollow tube being generally cylindrical in shape. Provided are also caps for the first and second end, with these caps being able to be attached and detached. Preferably, each of these caps have a number of grooves or slots therein for receiving therein a portion of the holiday light's cord. Additionally, a handle means may be provided for allowing the user to easily store and/or unwind the string of lights attached to the storage device.

In use, a user would place the string of lights first end through at least one of the first cap's slots. The user would then be able to wind the string of lights around the exterior surface of the storage device. When all but the string of lights second end had been wound around the exterior surface of the storage device, the user would then place the string of light's second end through the slot on the second end cap.

It is a first object of the present invention to provide a secure and convenient place to store Christmas lights. It is a second object of the present invention to provide a Christmas light storage device which allows the user to test and replace lights stored thereon without removing the string of lights from the device or disassembling the device. It is a third object of the present invention to provide a means for easily unstoring stored Christmas lights. It is a fourth object of the present invention to keep the light string from tangling and support attachments and bulbs with each string of lights. It is a fifth object of the present inventions to provide a storage place for spare light bulbs, fuses, hangers and other accessories.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
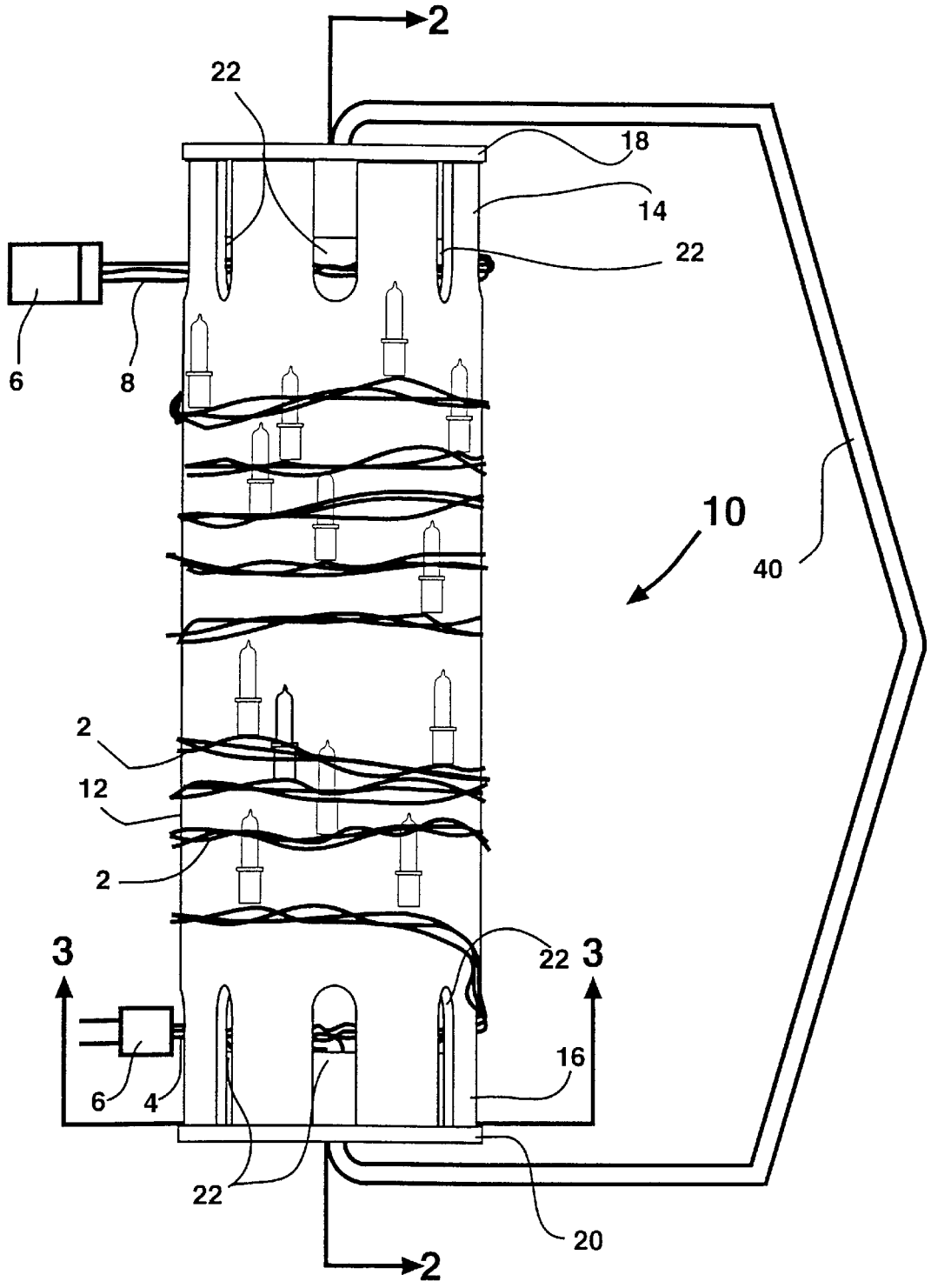
FIG. 1 is a first side view of one embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a storage device for storing Christmas, holiday, or other stringed lights. Referring initially to FIG. 1, one embodiment of the invented storage device 10 is shown. In this embodiment, the storage device 10 has a body 12 having an exterior surface 26 around which the Christmas light string can be wound. The body 12 comprises a tube having a hollow center, more particularly a round plastic cylinder of length between 10 to 20 inches. The preferred diameter of such a round cylinder (this embodiment) being 1.75 to 3.0 inches. Being a cylinder makes it easier to wrap and unwrap the Christmas light string. Being hollow allows for storage of spare light bulbs, fuses, hangers, and other accessories.

It is expressly envisioned that other embodiments could be created of solid cylinders or of other shapes, including prisms. Likewise, throughout this disclosure, other dimensions, variables, materials, shapes, sizes and the like are envisioned, with the above and below discussion only intended to express what the preferred embodiment or some of the alternative embodiments entail.

Figure 2:
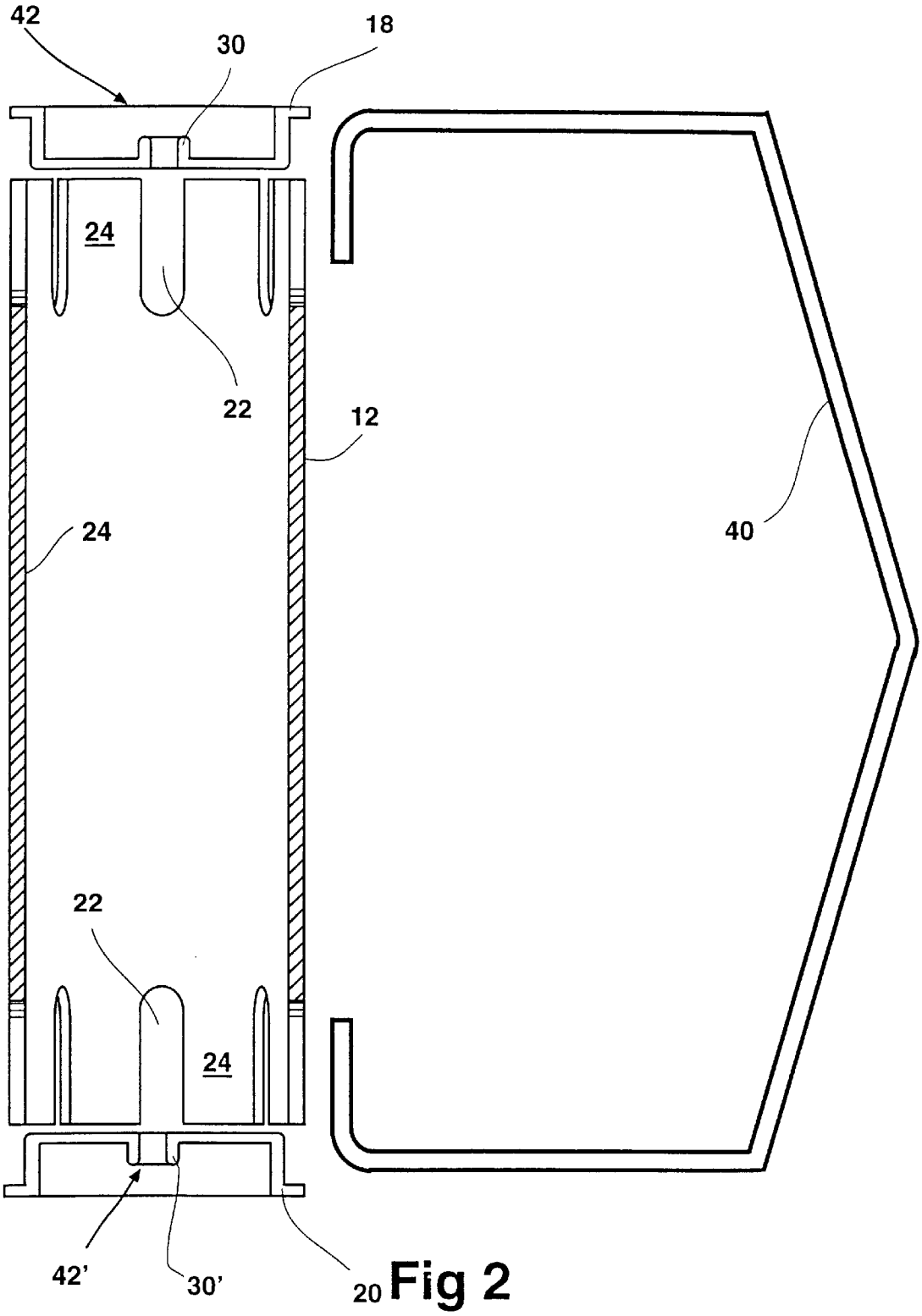
FIG. 2 is a cross sectional view of the embodiment of FIG. 1.

The body 12 has a first end 14 opposite a second end 16. The first end 14 has a number of slots or notches 22 therethrough the side wall (as shown in FIG. 2). For this embodiment, it is preferred that there be at least two of said slots 22 through the body 12, thereby allowing the second end 8 of the Christmas light string 2 with the attached plug 6 to extend therethrough from one slot to the other slot as shown in FIG. 1. Obviously, which end of the light string 2 extends through which end of the body 12 is merely a matter of user choice, and referring specifically to the first end 4 extending through the tube first end 14 is not intended as a limitation. In one version of this embodiment, eight equally slots spaced notches 22 of 0.1875 inch in width and 0.625 inch in length are utilized. The walls of these notches/slots 22 will be preferably smooth and rounded so as to protect the string of lights.

Likewise, the second end 16 has a number of slots 22. As with the first end, the second end likewise has at least two slots for allowing the first end 4 of the Christmas light string 2 and the attached plug 6' to be inserted there through. In one version of this embodiment, eight equally slots spaced notches 22 of 0.1875 inch in width and 0.625 inch in length are utilized. The walls of these notches/slots 22 will be preferably smooth and rounded so as to protect the string of lights.

For this embodiment, it is preferred that each end (14, 16) of the body 12 be slightly rounded and slightly larger than the body in diameter (for instance 0.0625 inch larger diameter). Doing so will assist in the attachment of caps (18, 20) to the body 12.

Releasably coupling the first end 14 is a first cap 18. The embodiment shown in FIG. 1 utilizes a cap which snaps inside of the body 12, however, other cap pin means are also envisioned, including buckles, snaps, caps which attach to the outside 26 of the body 12, caps which snap on the outside 26 of the body 12, etc. Likewise, a second cap 20 is able to engage the second end 16. Preferably, these caps 18, 20 are identical and interchangeable. Preferably, these caps 18, 20 will be approximately 0.375 inch in depth.

It is preferred that handle connection means 42, 42' be allowed to connect the first cap 18 and the second cap 20 to a handle means 40. In the embodiment shown, the handle means comprises the center of the caps 18, 20 having a raised protrusion 28 defining a hole 30 there through. The raised protrusion being 0.25 inches in height, 0.125 inches thick, having a hole 0.25 inches deep and 0.25 inches across, all preferably centered on the cap 18, 20.

The handle 40 comprises a round metal bar that will fit in the indentations in the middle of the caps 18, 20. In that embodiment, both ends of the round metal bar will extend approximately 1.0 inches from the caps 18, 20, make a right angled bend, be a length 1.0 inch longer than the radius of the cap, make a seventy-five degree corner and arc to the other end of the body 12 in a similar fashion, as shown in FIG. 2.

Referring now to FIG. 2, a cross sectional view of the embodiment of FIG. 1 is shown. This cross sectional view further shows the handle connection means 42, 42' comprising a hole 30 through the first cap 18 and the second cap 20, through which the first end 44 of the handle 40 and the second end 46 of the handle 40 can be inserted. This figure shows that the body 12 is a generally cylindrical tube having a side wall 24.

Figure 3:
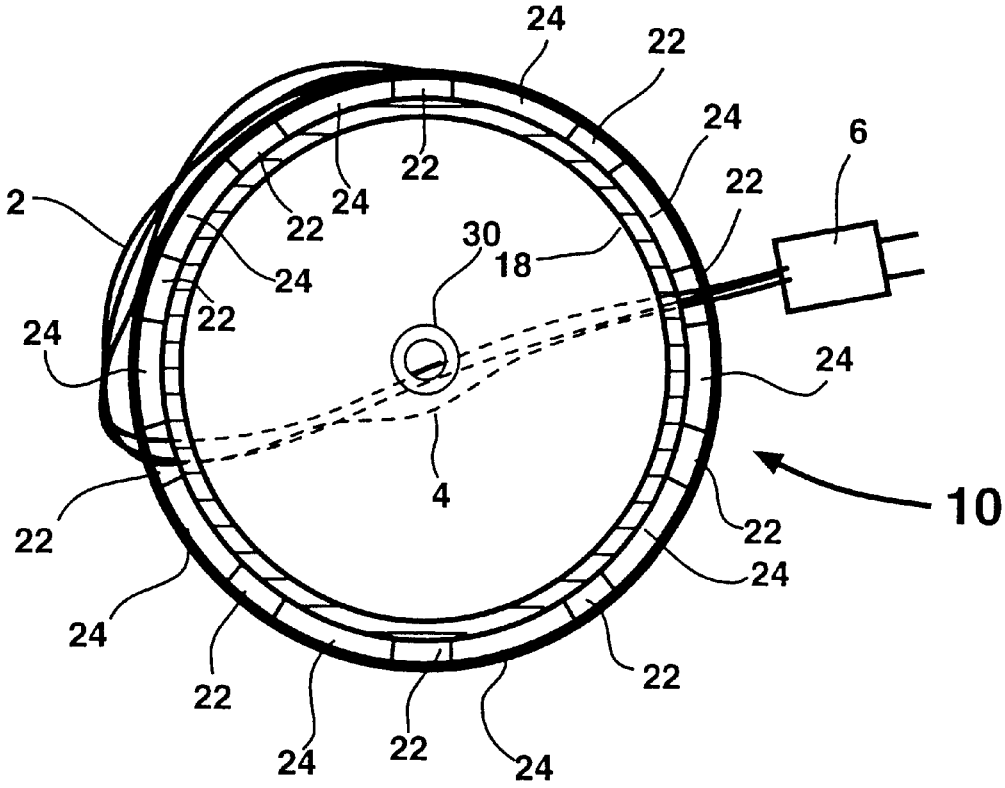
FIG. 3 is a top cross sectional view of the embodiment of FIG. 1.

Referring now to FIG. 3, a partial end view of FIG. 1 is shown. This figure shows side wall 24 having a plurality of slots 22 there through. In this embodiment, the number of notches is eight, with such slots being in opposing pairs.

Figure 4:
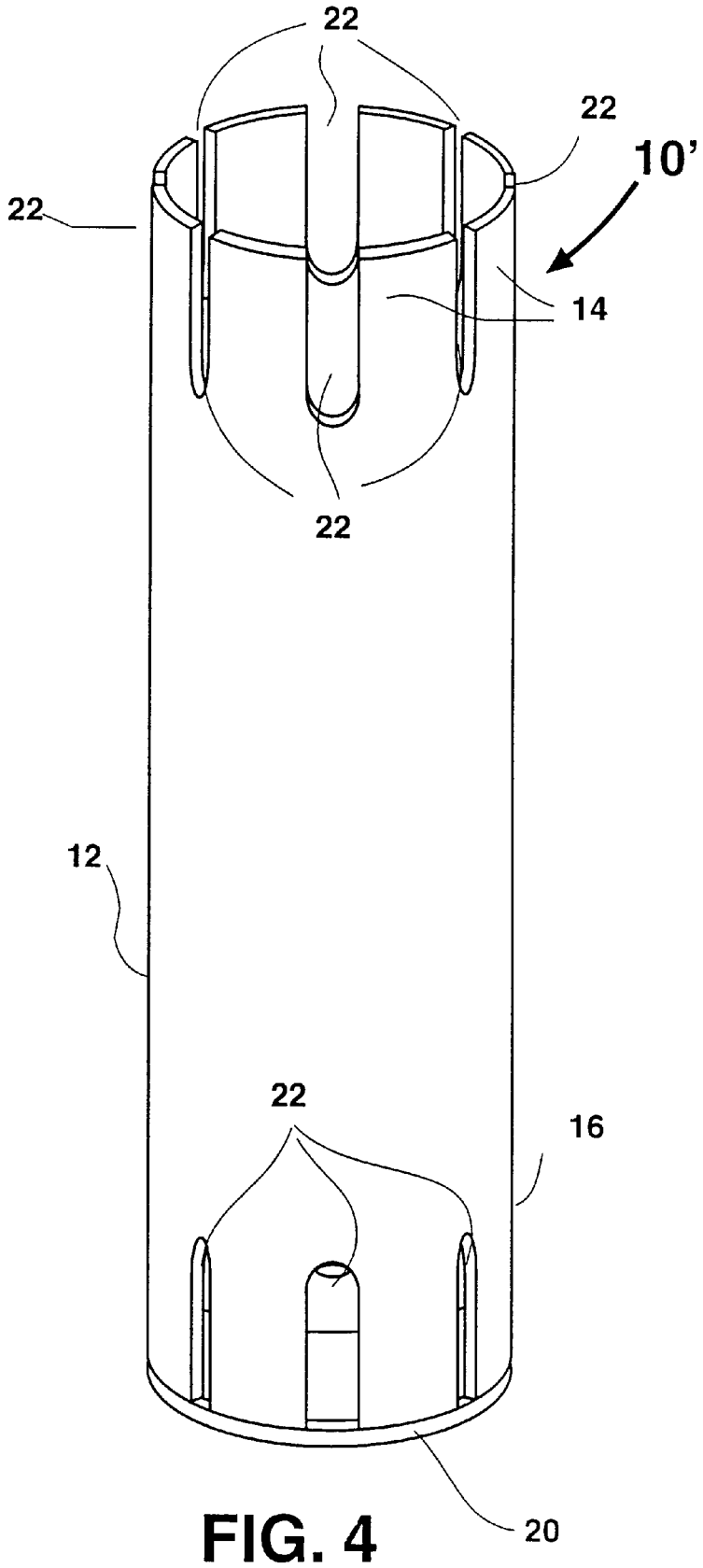
FIG. 4 is a perspective view of a second embodiment of the present invention.

Referring now to FIG. 4, a second embodiment of the present invention is shown. In this embodiment, the body 12 has a first end 14 opposite a second end 16. The first and second ends have a plurality of slots 22 there through the side wall 24. The body 12 has an exterior surface 26 around which a string of Christmas lights (not shown) can be wound. A cap means 20 is shown attached to the second end 16. The device 10' is not shown having a first cap 18, however such a cap could readily be provided.

Figure 5:
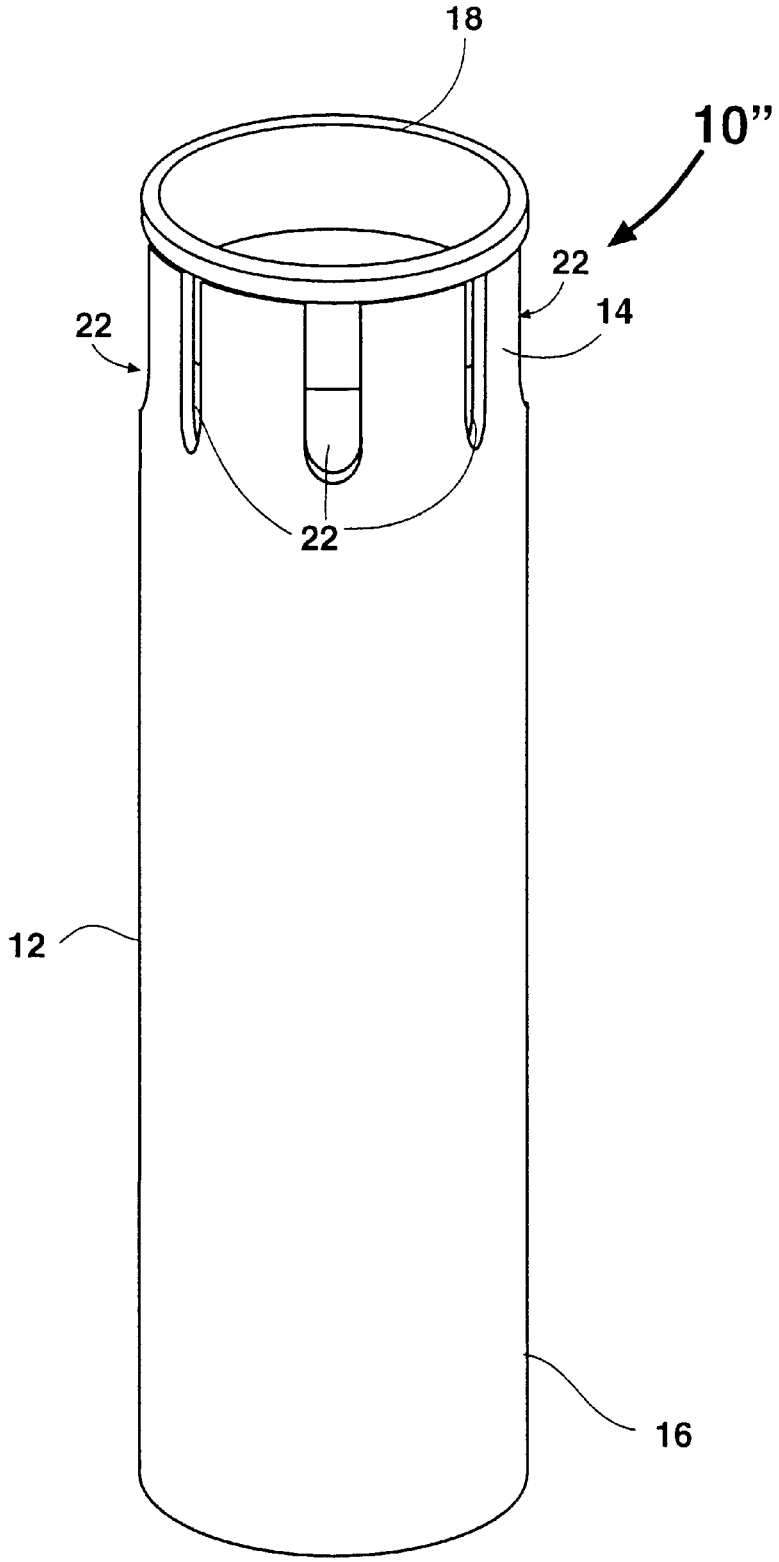
FIG. 5 is a perspective view of a third embodiment of the present invention.
Figure 6:
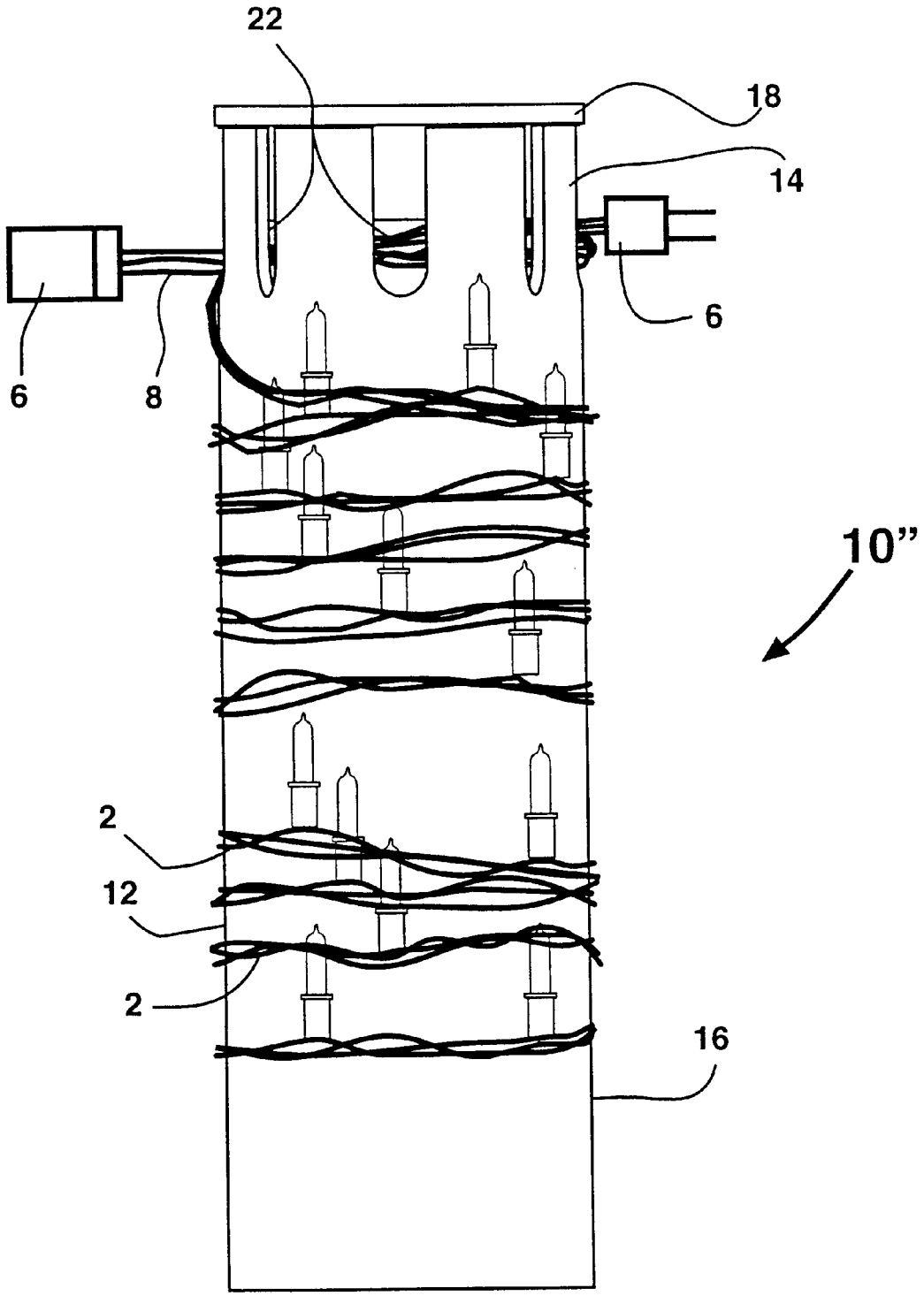
FIG. 6 is a side, environmental view of the embodiment of FIG. 5.

Referring now to FIG. 5, an alternate version of the present invention is shown. This device 10" has a body 12, a first end 14 opposite a second end 16. However, in this embodiment, notches 22 are only present within the first end 14. In use of such an embodiment, the user would insert the first end 4 through the slots, wind the string around the exterior surface 26 of the body 12 and then attaching the second end of the device through same or different slots 22, and finally attaching the cap 18 thereto to the end in order to hold the wound string onto the device 10", as shown in FIG. 6.

Figure 7A:
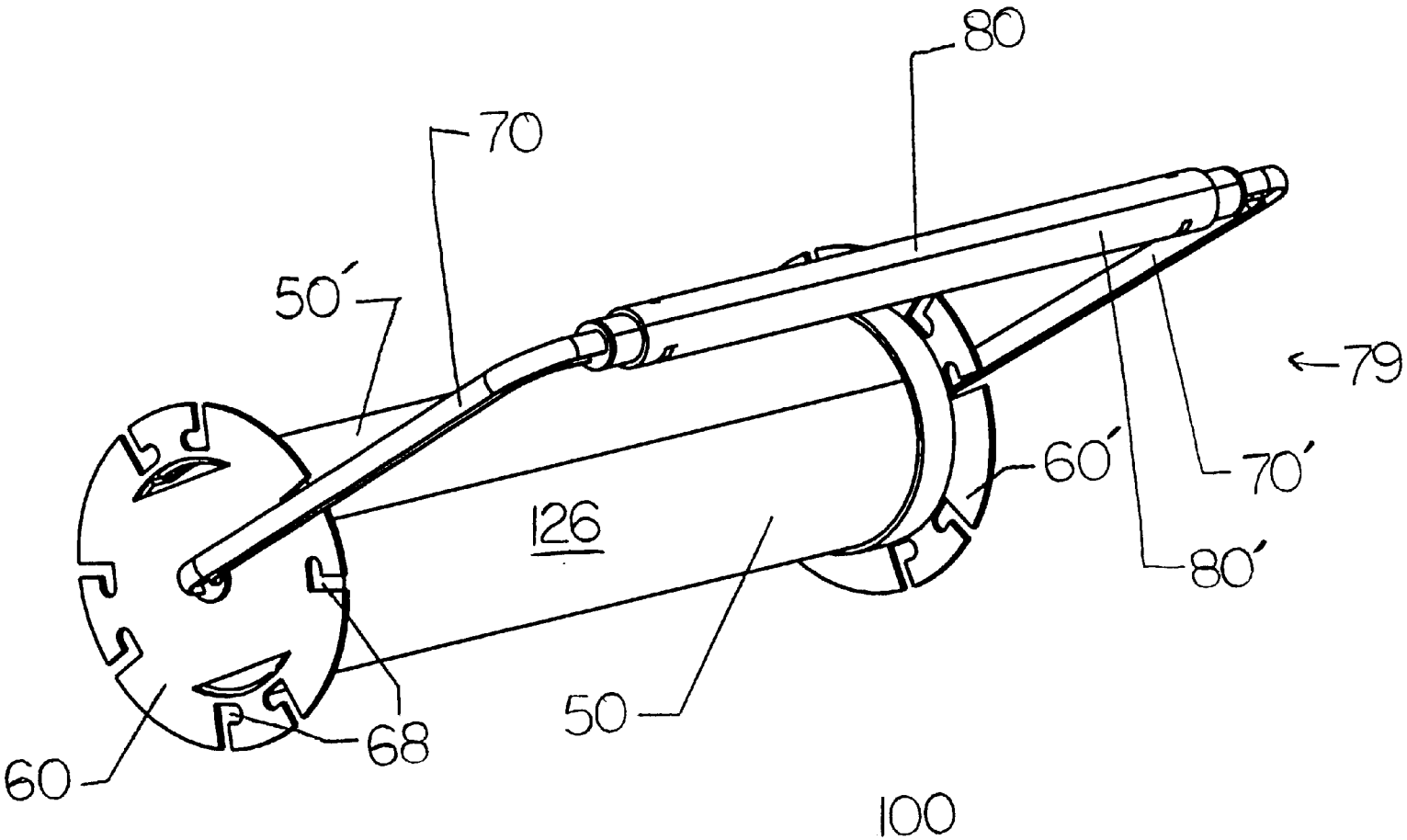
FIG. 7A is a perspective view of the preferred (fourth) embodiment of the present invention.
Figure 7B:
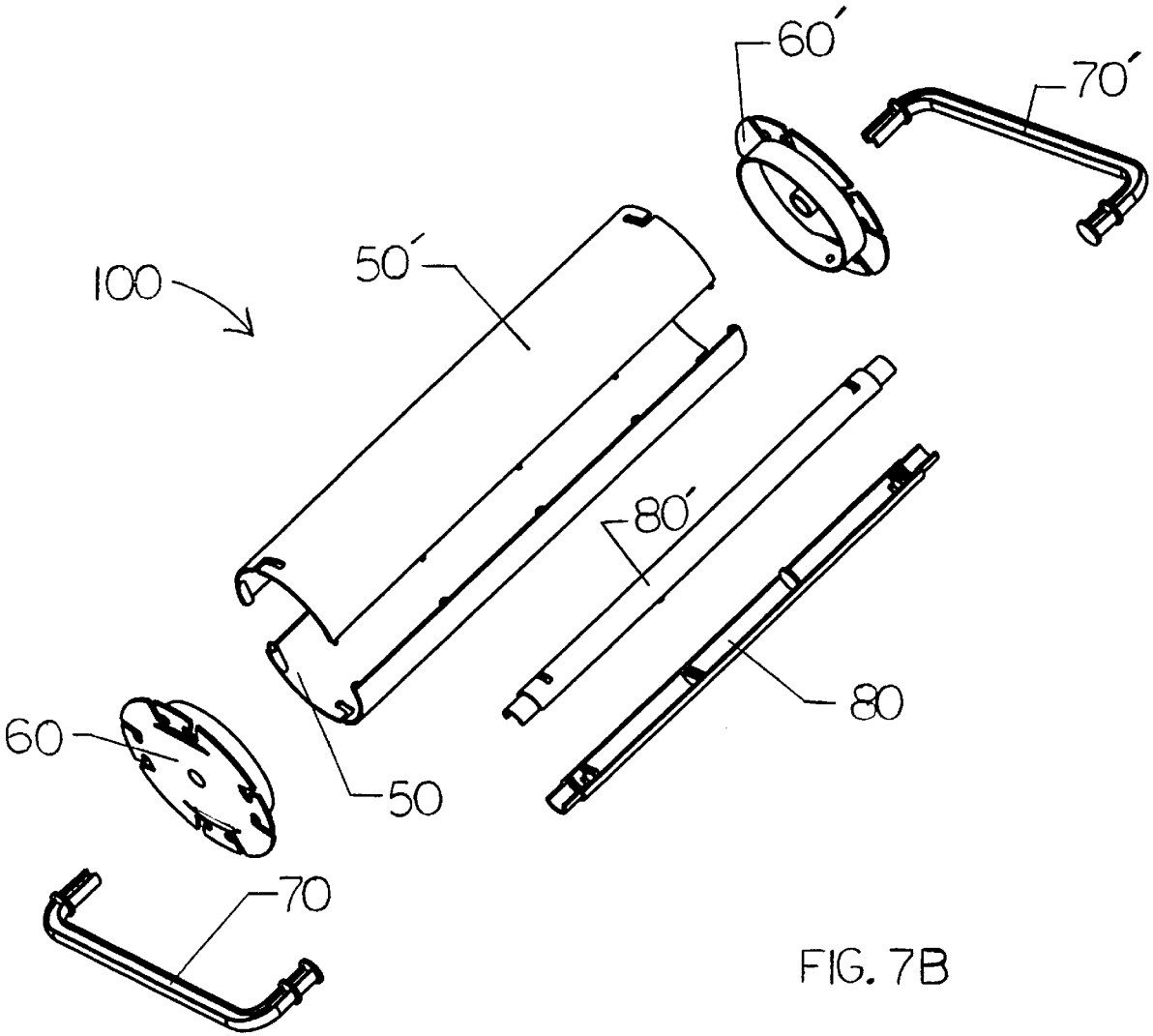
FIG. 7B is a perspective, exploded view of the embodiment of FIG. 7A.

Referring now to FIGS. 7A–7B, the preferred embodiment of the invented Christmas light storage device 100 is shown. This embodiment has a pair of mating body shells (50, 50') which are able to be attached together. These body shells 50, 50', after mating together, are able to attach to end caps 60, 60', as shown. These end caps further comprise a number of cord slots 68 for retaining a portion of a length of Christmas lights. Preferably, a pair of handle extensions 70, 70' rotationally attach to and extend from the end caps. A pair of mating handle grips 80, 80' attach between the two handle extensions, thereby constituting a handle for grasping by a user. FIG. 7A shows the preferred embodiment of the present invention assembled for use, whereas FIG. 7B shows an exploded view of the parts of FIG. 7A.

The embodiment of FIGS. 7A–7B shows a two-piece body comprising the two mated body shells. This body having an exterior surface 126 around which the Christmas light string can be wound. The preferred body comprises a tube having a hollow center, more particularly a round plastic cylinder of length between 10 to 20 inches. The preferred diameter of such a round cylinder (this embodiment) being 1.75 to 3.0 inches. Being a cylinder makes it easier to wrap and unwrap the Christmas light string. Being hollow allows for storage of spare light bulbs, fuses, hangers, and other accessories. Other bodies are also possible, including one piece and more than two piece bodies. It is expressly envisioned that other embodiments could be created of solid cylinders or of other shapes, including prisms. Likewise, throughout this disclosure, other dimensions, variables, materials, shapes, sizes and the like are envisioned, with the above and below discussion only intended to express what the preferred embodiment or some of the alternative embodiments entail.

In the embodiment shown in FIGS. 7A–7B, the end caps 60, 60' slide onto the ends of the mated body shells 50, 50'. However, other configurations of end cap attachment is also envisioned, including, but not limited to end caps which attach to the inside of mated body shells. Other types of handles and handle arrangements are also envisioned.

Figure 8:
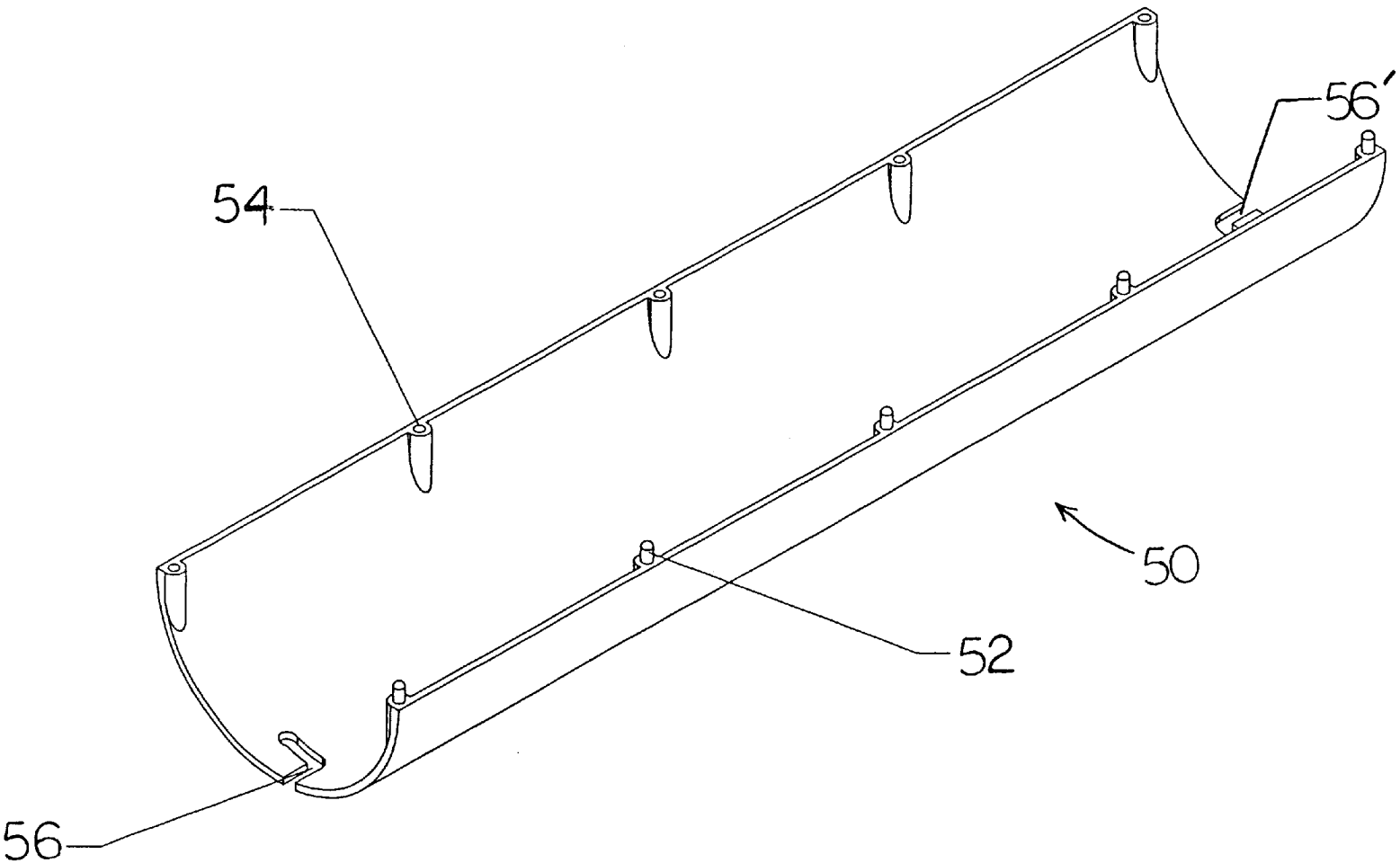
FIG. 8 is a perspective view of the body shell of the embodiment of FIG. 7.

Referring now to FIG. 8, shown is one embodiment of a body shell 50 utilized with the preferred embodiment of the present invention. The body shell 50 comprises a generally semicircular half pipe body having a pair of parallel rims. A number of pins 52 and a number of pin holes 54 are provided in the rims. In the embodiment shown, pins 52 are provided on one rim and pins holes 54 on the opposite rim. In such a manner, the first body shell and the second body shell can be identical, and when properly rotated will mate. In an alternative embodiment, the first body shell 50 could have pins with the second body shell 50' (not shown) having the pin holes. Other means of attaching the first body shell to the second body shell are also envisioned.

Figure 9:
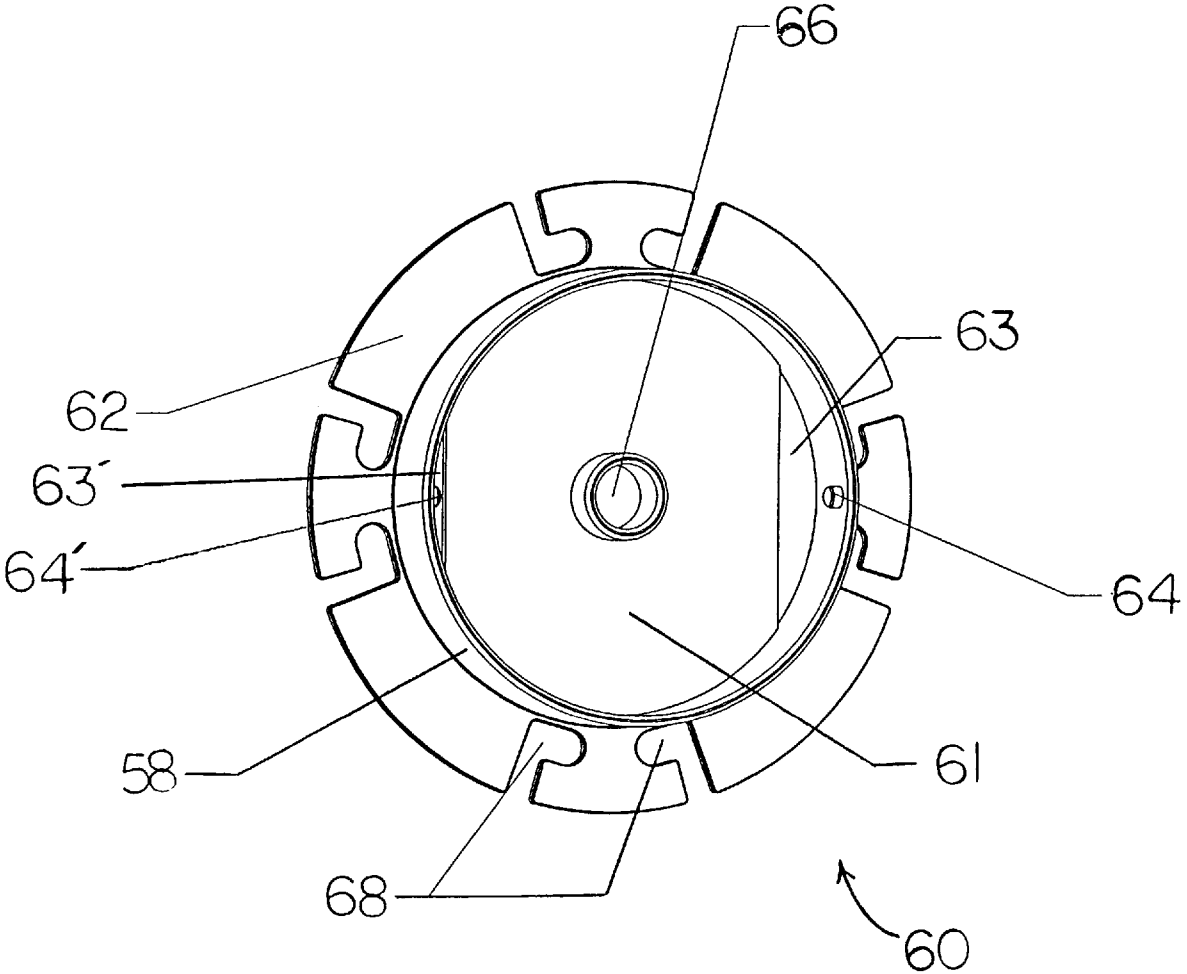
FIG. 9 is a perspective view of the end cap of the embodiment of FIG. 7.

The preferred embodiment also uses a pair of cap engagements, or locking slots 56, 56'. These locking slots are able to cooperate with analogous locking tangs 64, 64' provided on the inside surface of the cap body flange 58, as shown in FIG. 9. In use, the cap can be slid onto the end of the body formed from the mating body shells with the cap tangs sliding into the locking slots. Twisting the cap onto the body thereby locks the cap onto the body. It is preferred that slots be provided on both body shell as well as on opposite sides of the inside of the cap body flange.

Referring again to FIG. 9, shown is one embodiment of an end cap 60 utilized with the preferred embodiment of the present invention. Shown is the inside of the end cap. This end cap able to releasably couple with one, preferably either one, of the ends of the body. Likewise, a second cap would be able to engage the second end of the body. Preferably, these caps are identical and interchangeable. The end cap 60 shown having an end 61 having a releasable handle attachment means or orifice 66 therethrough for receiving the cap connection 72 of the handle extension 70 (shown in FIG. 10). It is preferred that this orifice 66 be located within the center of the end so that the rotation of the cap around the connection with the handle extension will be regular. Attaching to and/or extending from the end 61 is an annular ring or body flange 58, this flange able to contact and connect with the end of the body (paired body shells) as shown in FIG. 7A. Within the end 61 is preferably a slot 63, 63' adjacent the tang (described below) for allowing a user to more easily place the cap upon the body.

In this embodiment, the inside surface of this body flange further comprises at least one tang 64, 64' for inter-fitting connection with the locking slots of the body shell (as shown in FIG. 8). Preferably extending perpendicular to the body flange and parallel or otherwise in alignment with the end 61 is an end flange 62. This end flange radiating outwards from the end cap. In the preferred embodiment, this end flange 62 defines a number of cord slots 68 therein for connecting with the Christmas lights stored upon the device 100, for instance the ends of the string of lights. Other embodiments of end caps are also envisioned.

It is preferred that a handle 79 (shown in FIG. 7A) be utilized with the present invention to facilitate ease of use of the present invention. In the embodiment shown in FIGS. 7A–11, this handle 79 comprises a pair of handle extensions 70, 70' and a pair of handle grips 80, 80'.

Figure 10:
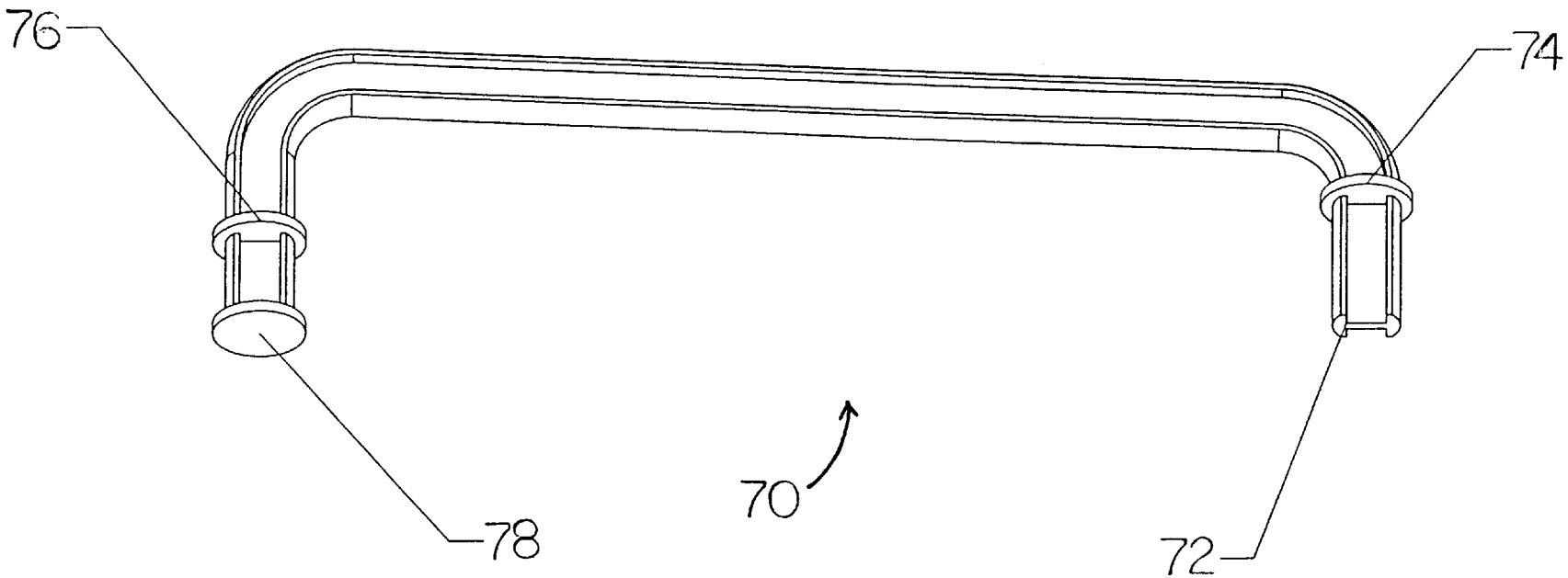
FIG. 10 is a perspective view of the handle extension of the embodiment of FIG. 7.
Figure 11:
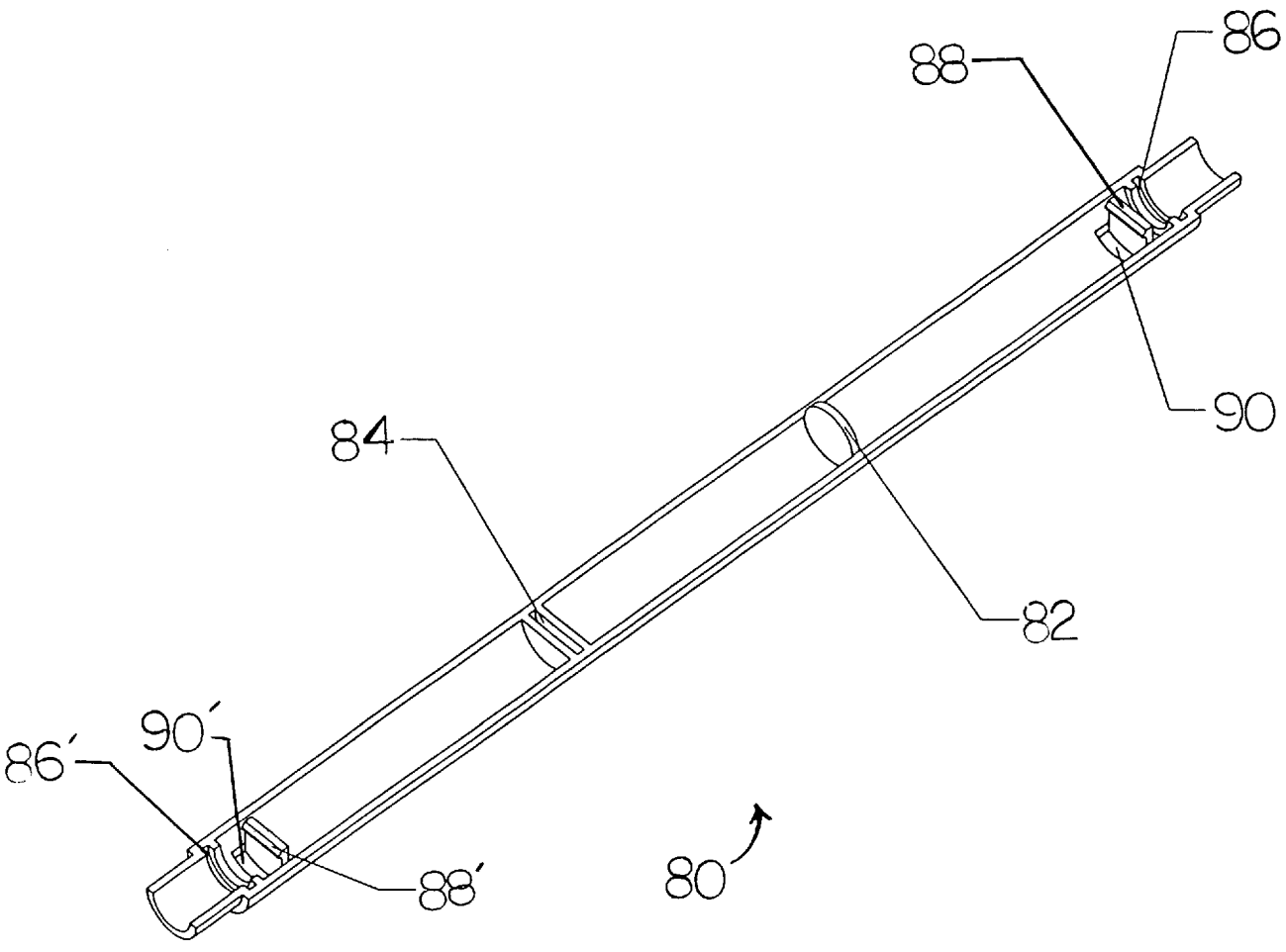
FIG. 11 is a perspective view of the handle grip of the embodiment of FIG. 7.

Referring now to FIG. 10, shown is one embodiment of a handle extension 70 utilized with the preferred embodiment of the present invention. This handle extension 70 being generally C-shaped, having a first end extending and curving to a second end. This first end comprising a cap connection 72 able to be inserted into and configured for rotation attachment to the orifice 66 of the end cap 60 (shown in FIG. 9). A cap flange 74 is preferably provided for limiting the movement of that cap connection 72 into the orifice 66. Likewise, a grip flange is provided near said second end for limiting the movement of the second end with respect to the handle grip 80 (as shown in FIG. 11). At said second end a grip pivot flange 80 is provided for providing a pivotal attachment with said handle grip 80. This pivot flange able to rotate within the grip pivot slot 86 of the handle grip 80 (as shown in FIG. 11). Other handle extensions are also envisioned.

Referring now to FIG. 11, shown is one embodiment of a handle grip 80 utilized with the preferred embodiment of the present invention. This handle grip 80 has a handle flange 82 configured for receipt into a corresponding handle groove (84) on a mated handle grip (80'). Likewise, a handle groove 84 is provided for receiving a handle flange (82) of a mated handle grip (80'). Thus, when configured as shown in FIG. 11, two of shown configuration handle grips can be mated together through merely rotating and flipping the second of the pair, as shown in FIG. 7B. Alternatively, only flanges could be located on one grip and only grooves on the mating grip or, other means for connecting the two grips together could be utilized. Also, a single piece grip could be utilized.

The grip contains a pair of grip pivot slots 86, 86' for receiving therein the grip pivots of a handle extension. In such a manner a second handle grip could be snapped onto the first handle grip having the handle extension grip pivots received therein, thereby fixedly yet rotationally holding the handle extensions. It is preferred that a locking clips 88, 88' be configured for snapping together with like oriented locking clips of the second handle grip for holding the handle grip on the handle extension as described above. Additionally, it is preferred that locking clip holes be provided within the handle grips adjacent the locking clips so that a flat-head screwdriver or other means can be inserted therein for the purpose of unlocking the engagement of the locking clips together thereby allowing the mating handle grips to be disengaged from one another and the handle extensions disengaged from connection as well. Other means of attaching the first handle grip to the second handle grip are also envisioned.

In use, a user would place the string of lights first end through at least one of the first end cap's cord slots. The user would then be able to wind the string of lights around the exterior surface of the storage device. When all but the string of lights second end had been wound around the exterior surface of the storage device, the user would place the string of lights second end through at least one of the second end cap's cord slots. Then, through use of the handle, the user could hang the wound string(s) of lights on a hook, nail, etc., thereby storing the lights for easy retrieval at a later time.

The present invention is configured so that the inside of the tube (body shell) is available for storage of miscellaneous parts, for instance replacement lights, fuses, light hangers, etc. Additionally, through the preferred configuration, the handles can be disassembled and stored within the body shell as well, a fact which particularly lends itself to ease of packaging and storage when not in use.

While there is shown and described the present preferred embodiment of the invention, it is to be distinctly understood that this invention is not limited thereto but may be variously embodied to practice within the scope of the following claims.

I claim:

1. A storage device for storing at least one string of Christmas lights, said string of Christmas lights having a plurality of light bulbs connected together by wires, said string of Christmas lights having a string first end terminating in a first electrical plug coupled to said wires, said string of Christmas lights having a string second end terminating in a second electrical plug coupled to said wires, said storage device comprising:

a pair of mating body shells which are able to be attached together to form a body, said body being generally cylindrical in shape having a body first end extending to a body second end, said body being generally tubular in shape defining a passageway there through;

a first end cap able to attach to said body first end, said first end cap comprising at least one cord slot for retaining said string first end, said first end cap comprising a first handle attachment for allowing said first end cap to rotationally attach to a handle;

a second end cap able to attach to said body second end, said second end cap comprising at least one cord slot for retaining said string second end, said second end cap comprising a second handle attachment for allowing said second end cap to rotationally attach to said handle;

a handle for grasping by a user, said handle attaching to said device via said first and second handle attachments.

2. The storage device of claim 1, wherein said handle comprises first and second handle extensions rotationally attaching to and extend from said end caps at said first and second handle attachments, wherein said handle comprises a pair of mating handle grips attaching between said handle extensions.

3. The storage device of claim 1, wherein said end caps are able to attach to said body ends by sliding onto said body ends.

4. The storage device of claim 1, wherein said first and second body shells are generally semicircular half pipe in shape.

5. The storage device of claim 4, wherein said body shells each further comprise a pair of parallel rims.

6. The storage device of claim 5, wherein said parallel rims further comprise a plurality of pins and define a number of pin holes.

7. The storage device of claim 6, wherein said first body shell parallel rim pins and pin holes are able to mate with said second body shell parallel rim pins and pin holes.

8. The storage device of claim 1, wherein said body first end and said body second end each comprise at least one pair of locking slots.

9. The storage device of claim 8, wherein said locking slots are able to cooperate with analogous locking tangs provided on said end caps, thereby locking said end caps on said body ends.

10. The storage device of claim 1, wherein said handle comprises a pair of handle extensions and a pair of handle grips.

11. The storage device of claim 10, wherein said handle extensions are generally C-shaped, having extension first ends extending and curving to extension second ends.

12. The storage device of claim 11, wherein said extension first ends comprise cap connections able to be inserted into and configured for rotational attachment to the first and second handle attachments of said first and second end caps.

13. The storage device of claim 12, wherein said handle extensions further comprise cap flanges for limiting the movement of said cap connections into said orifices.

14. The storage device of claim 11, further comprising at least one grip flange near each of said extension second ends, said grip flange for limiting the movement of the second end with respect to said handle grip.

15. The storage device of claim 11, wherein said extension second ends each further comprise a grip pivot flange for providing pivotal attachment with said handle grips, said handle grips each having a grip pivot slot in which said grip pivot flange can rotate.

16. The storage device of claim 10, wherein said handle grip pair comprise a first handle grip and a second handle grip, wherein said first handle grip comprises a handle flange configured for receipt into a corresponding handle groove on said second handle grip.

17. The storage device of claim 16, wherein said first and second handle grips further comprise interlocking locking clips for allowing said first and second handle grips to be locked together.

18. A storage device for storing at least one string of Christmas lights, said string of Christmas lights having a plurality of light bulbs connected together by wires, said string of Christmas lights having a string first end terminating in a first electrical plug coupled to said wires, said string of Christmas lights having a string second end terminating in a second electrical plug coupled to said wires, said storage device comprising:

a pair of mating body shells which are able to be attached together to form a body, said body being generally cylindrical in shape having a body first end extending to a body second end, said body being generally tubular in shape defining a passageway there through;

a first end cap able to attach to said body first end, said first end cap comprising at least one cord slot for retaining said string first end, said first end cap comprising a first handle extension attachment for allowing said first end cap to rotationally attach to a handle;

a second end cap able to attach to said body second end, said second end cap comprising at least one cord slot for retaining said string second end, said second end cap comprising a second handle extension attachment for allowing said second end cap to rotationally attach to said handle;

a handle for grasping by a user, wherein said handle comprises first and second handle extensions rotationally attaching to and extend from said end caps at said first and second handle extension attachments, wherein said handle comprises a pair of mating handle grips attaching between said handle extensions.

* * * * *